US007113735B2

(12) United States Patent
Schlien et al.

(10) Patent No.: US 7,113,735 B2
(45) Date of Patent: Sep. 26, 2006

(54) PRECISION RELEASE AGENT MANAGEMENT SYSTEM

(75) Inventors: Ruediger Schlien, Freiberg (DE); Randall J. Taylor, Bergen, NY (US); Fangsheng Wu, Rochester, NY (US); Gregory L. Kowalski, Victor, NY (US); Richard Berg, Greenville, SC (US); Mikhail E. Fishkin, Rochester, NY (US); David F. Cahill, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 1 day.

(21) Appl. No.: 10/974,414

(22) Filed: Oct. 27, 2004

(65) Prior Publication Data

US 2006/0088347 A1 Apr. 27, 2006

(51) Int. Cl.
*G03G 15/20* (2006.01)

(52) U.S. Cl. ..... 399/325; 118/DIG. 1

(58) Field of Classification Search ..... 399/325, 399/324, 326, 274; 118/60, DIG. 1
See application file for complete search history.

(56) References Cited

U.S. PATENT DOCUMENTS 3,846,151 A * 11/1974 Roteman et al. ..... 118/DIG. 1
5,160,970 A * 11/1992 Isogai ..... 399/325
5,341,198 A * 8/1994 Pawlik et al. ..... 399/325
5,374,983 A * 12/1994 Isogai ..... 399/325
5,477,316 A * 12/1995 Morganti et al. ..... 399/324
5,732,316 A * 3/1998 Yamasaki et al. ..... 399/325
5,839,041 A * 11/1998 Condello et al. ..... 399/325
5,940,672 A * 8/1999 Kagawa ..... 399/325
6,577,838 B1 * 6/2003 Fujita et al. ..... 399/325

* cited by examiner

*Primary Examiner*—David M. Gray
*Assistant Examiner*—Laura K. Roth
(74) *Attorney, Agent, or Firm*—Lawrence P. Kessler

(57) ABSTRACT

A precision release agent management system for an electrostatographic reproduction apparatus fuser device. The precision release agent management system includes a reservoir adapted to contain a release agent. A wick absorbs release agent from the reservoir. A metering member receives release agent from the wick, which is supported for resiliently urging into operative contact with the metering member. A blade member is associated with the metering member to establish a desired thickness of release agent on the metering member, and a donor member is adapted to receive release agent from the metering member, and operatively contact the fuser device to apply the release agent thereto. A plurality of features is associated with the reservoir for precise alignment of the donor member, the metering member, and the metering blade.

10 Claims, 5 Drawing Sheets

PRECISION RELEASE AGENT MANAGEMENT SYSTEM

FIELD OF THE INVENTION

This invention relates in general to a fusing apparatus for an electrostatographic reproduction device, and more particularly to a precision release agent management system for the fusing apparatus for an electrostatographic reproduction device.

BACKGROUND OF THE INVENTION

In electrostatographic reproduction apparatus, such as electrophotographic copier/duplicators, printers, or the like, a light image of an original document to be printed or copied is typically recorded by either digital or analog devices as an electrostatic latent image upon a photosensitive member. Subsequently, the latent image is rendered visible (i.e., developed) by application of electrostatically charged marking particles, commonly referred to as toner. The developed toner image can be either fixed directly upon the photosensitive member, or transferred from the photosensitive member to another support substrate, or receiver member, such as a sheet of plain paper, with subsequent affixing of the toner image thereto.

In order to fix or otherwise fuse the toner material onto a receiver member permanently, it is generally necessary to apply heat so as to elevate the toner material to a temperature at which constituents of the toner material coalesce and become tacky. This action causes the toner to flow to some extent into the fibers or pores of the receiver member or to otherwise adhere to the surface thereof. Thereafter, as the toner material cools, solidification occurs causing the toner material to be bound firmly to the receiver member.

One method for thermal fusing of toner images onto a receiver member has been to pass the receiver member with an unfused toner image thereon between a nip formed by a pair of opposed roller members that are in contact with each other, wherein at least one of the roller members is heated. During operation of a fusing system of this type, the receiver member to which the toner image is electrostatically adhered is moved through the nip formed between the rolls with the toner image contacting the fuser roller thereby to affect heating of the toner image within the nip. Typical of such fusing devices are two roller systems wherein a fuser roller is coated with an adhesive material, such as a silicone rubber; other low surface energy elastomers, such as a Viton® fluoroelastomers available from E.I. DuPont De Nemours of Wilmington, Del.; or other low surface energy material, such as tetrafluoroethylene polymer resins like, for example, Teflon® resins also sold by DuPont.

In the foregoing fusing systems, however, since the toner image is tackified by heat, it frequently happens that a part of the image carried on the receiver member will be retained by the heated fuser roller and not penetrate into the receiver member surface. This tackified material can stick to the surface of the fusing roller and come in contact with a subsequent receiver member bearing another toner image to be fused. Thus, a tackified image, which has been partially removed from a first receiver member, may thereafter transfer to a subsequent second receiver member in non-image portions of the second receiver member. In addition, a portion of the tackified image of the second receiver member may also adhere to the heated fuser roller. In this way and with the fusing of subsequent sheets bearing toner images, the fuser roller can eventually become thoroughly contaminated and unusable, thereby requiring replacement of the fuser roller itself. In addition, since the fuser roller continues to rotate when there is no substrate bearing a toner image to be fused, toner that may be adhered to the fuser roller can be transferred from the fuser roller to the pressure roller, and also to other rollers and components associated with the fuser system, thereby contaminating the overall fuser system. The foregoing conditions are referred to generally in the printing/copying art as "offset". Attempts have been made to control heat transfer to the toner and thereby control offset. However, even with adhesive surfaces provided by the silicone elastomers and the other materials mentioned hereinabove, this has not been entirely successful.

It has also been proposed to provide toner release agents such as silicone oil, and in particular poly(organosiloxane) oils like poly(dimethylsiloxane), that are applied to the surface of the fuser roller to act as a polymeric release agent and thereby reduce offset. The use of such release agents is reported, for example, in U.S. Pat. Nos. 3,964,431 and 4,056,706, the teachings of which are incorporated herein by reference. These release agents possess a relatively low surface energy and have been found generally suitable for use in a heated fuser roller environment. In practice, a thin layer of poly(organosiloxane) oil (also referenced as silicone oil hereinafter) release agent is applied to the surface of the heated fuser roller to form an interface between the fuser roller surface and the toner image carried on the support material. Thus, a low surface energy, easily parted layer is presented to the toners that pass through the fuser toning nip and thereby reduces the amount of toner which offsets to the fuser roller surface.

Various methods are known for applying release agent materials to a fuser member such as a heated fuser roll. One such system comprises a Release Agent Management (RAM) system including a donor roll that contacts the fuser member to which the oil or release agent material is applied. The donor roll also contacts a metering roll, which conveys the oil from a supply of oil to the donor roll. With such a system, it is customary to use a metering blade to meter the silicone oil or other suitable release agent material to a desired thickness onto a metering roll. In the fusing of monochrome (i.e. black on a conventional imaging substrate) the uniformity of the oil layer on the metering roll is not so critical compared to that required for color toner images, particularly, those associated with transparency substrate materials used for optically projecting the color images.

SUMMARY OF THE INVENTION

In view of the above, this invention is directed to a precision release agent management system for an electrostatographic reproduction apparatus fuser device. The precision release agent management system includes a reservoir adapted to contain a release agent. A wick absorbs release agent from the reservoir. A metering member receives release agent from the wick, which is supported for resiliently urging into operative contact with the metering member. A blade member is associated with the metering member to establish a desired thickness of release agent on the metering member, and a donor member is adapted to receive release agent from the metering member, and operatively contact the fuser device to apply the release agent thereto. A plurality of features is associated with the reservoir for precise alignment of the donor member, the metering member, and the metering blade.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
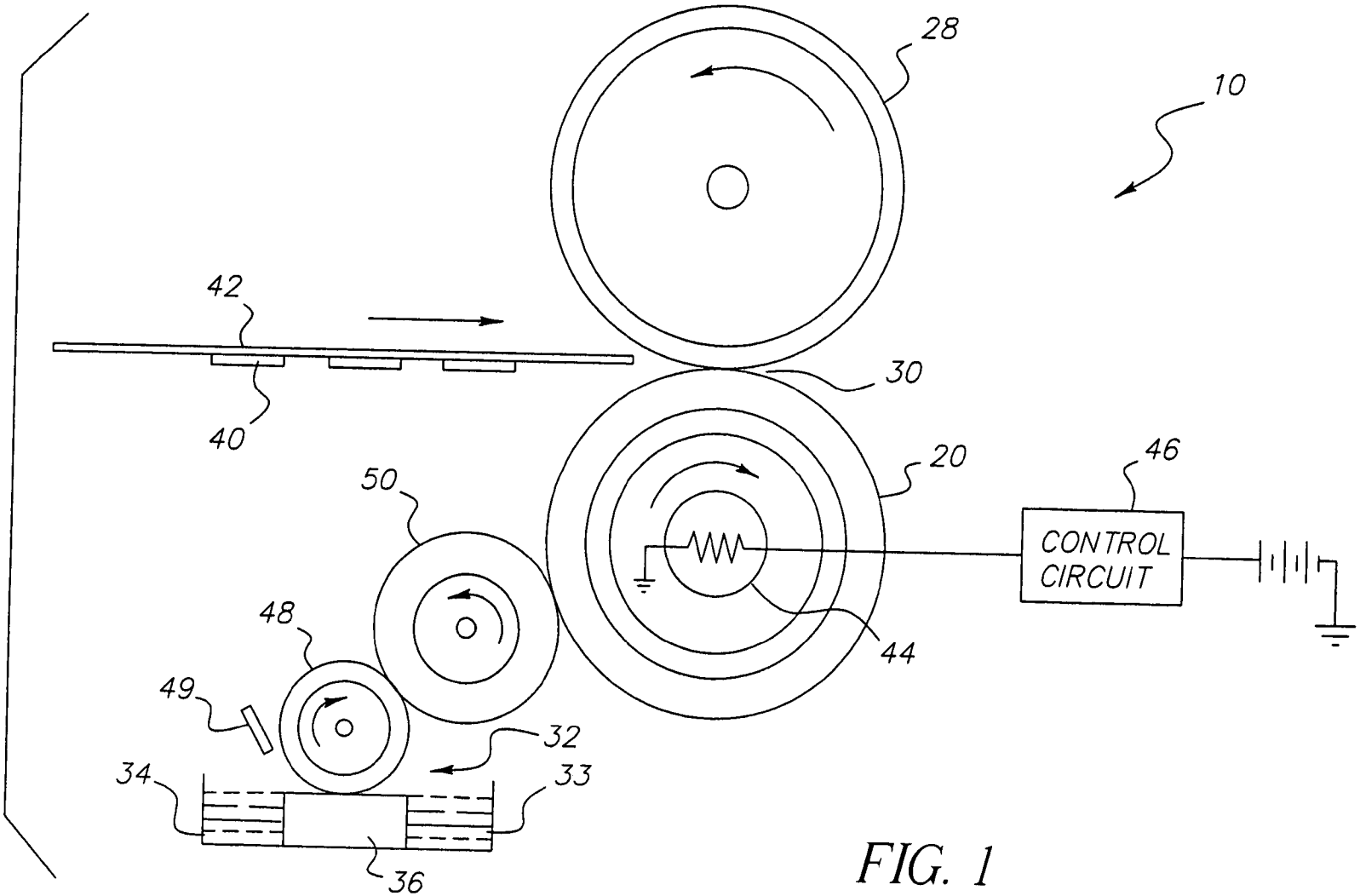
FIG. 1 is a schematic, front, cross-sectional view of a fuser system incorporating the precision release agent management system in accordance with the present invention.

Referring to the accompanying drawings, FIG. 1 shows an exemplary fuser system 10 for a typical electrostatographic reproduction apparatus. The fuser device 10 includes a fuser roller 20 and an elastomeric pressure roller 28, which form a toning nip 30. A supply of polymeric release agent 33 is shown provided in a polymeric release agent reservoir 34. The fuser roller 20 can be made of any material known to the art and which employs an outer surface comprised of a material, which uses or can use a polymeric release agent as described hereinafter. Generally, the outer surfaces of the fuser roller 20 and pressure roller 28 comprise an elastomeric material, such as silicone elastomers, fluoroelastomers, and so-called interpenetrating networks of silicone and fluoroelastomers. Such materials are disclosed, for example, in the U.S. Patents previously incorporated herein by reference, as well as U.S. Pat. Nos. 5,141,788; 5,166,031; 5,281,506; 5,366,772; 5,370,931; 5,480,938; 5,846,643; 5,918,098; 6,037,092; 6,099,673; and 6,159,588, the teachings of which are also incorporated herein by reference. Another type of suitable material is a fluorocarbon-based, curable, thermoplastic random copolymer material, which in preferred embodiments utilize so-called THV thermoplastic fluoropolymers, such as those polymer materials disclosed in U.S. Patent Application entitled "FLUOROCARBON THERMOPLASTIC RANDOM COPOLYMER COMPOSITION", U.S. Ser. No. 09/609,561, filed Jun. 30, 2000, the teachings of which are also incorporated herein by reference in their entirety.

Particulate imaging material 40, such as toner, disposed on a receiver 42 is fused into the receiver 42 at the fusing nip 30 by the application of heat and pressure. As shown, a heating lamp 44 is connected to a control circuit 46. The heating lamp 44, as known to those skilled in the art, may be provided inside the core of the fuser roller 20 as shown in FIG. 1. The fuser roller 20 can also be externally heated by a heated roller (not shown), which is opposed to and can ride along in frictional contact with the fuser roller 20. This external heat source may replace or merely assist the internal lamp 44. It should be understood, however, that depending on the particulate imaging material 40 used, in some cases only pressure may need to be applied to fuse particulate imaging material 40 into the receiver 42.

A wicking device 32 in a form including of a wick 36, absorbs polymeric release agent 33 contained within reservoir 34. The wick 36 conveys the polymeric release agent 33 from reservoir 34 by wicking action to a metering roller 48, which contacts or is otherwise placed in close proximity to wick 36. Due to the rotational action (as shown by the arrow within metering roller 48 in FIG. 1) of metering roller 48, such contact with wick 36 draws a thin film of the polymeric release agent 33 onto the exterior surface of metering roller 48. A metering blade 49 is positioned above the polymeric release agent level in reservoir 34 and adjacent to metering roller 48 such that the amount of polymeric release agent applied and thickness of the film can be controlled to desired levels. The metering roller 48 can be positively driven, but is more conveniently driven by frictional contact with a release agent donor roller 50 as described hereinafter.

Disposed in an opposed, contacting relationship and intermediate position between the fuser roller 20 and the metering roller 48 is a release agent donor roller 50. The release agent donor roller 50, due to rotational action (as shown by the arrow within donor roller 50 in FIG. 1) and contact with metering roller 48, receives the polymeric release agent 33 from metering roller 48 and delivers the polymeric release agent as a thin film to the outer surface of the fuser roller 20. Fuser roller 20 due to rotational action (as shown by the arrow within fuser roller 20 in FIG. 1) thereafter delivers the polymeric release agent to fusing nip 30, such that the presence of the polymeric release agent on the surface of the fuser roller 20 thereby acts to prevent or at least substantially reduce offset of particulate imaging material 40 on the fuser roller surface 20. A continuous supply of polymeric release agent 33 is provided, which is applied by the fuser roller 20 in an effective amount of from about 1 to about 20 milligrams per letter size receiver 42, on which particulate imaging material 40 is fixed. This polymeric release agent 33 is discussed further hereinafter.

Figure 2:
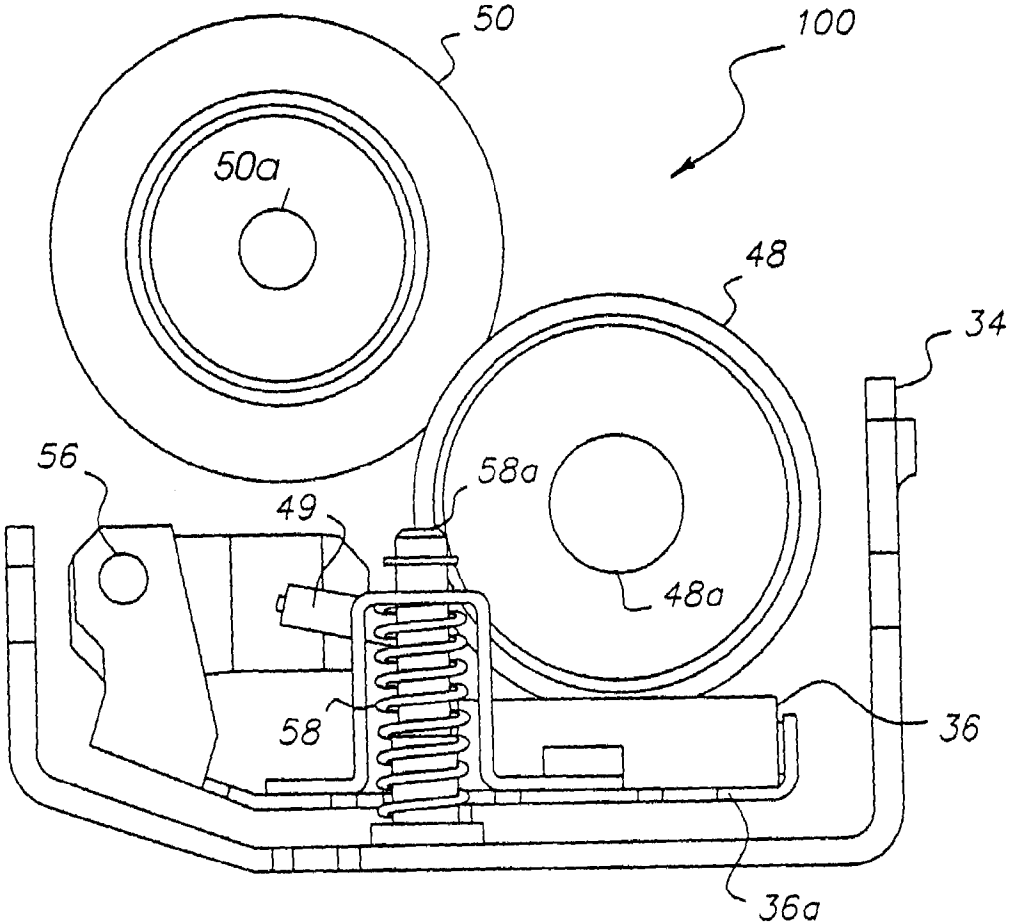
FIG. 2 is an enlarged view, partly in cross-section, of the precision release agent management system in accordance with the present invention.

Referring now to FIG. 2, the release agent donor roller 50 comprises a base member, which is generally in the form of a solid or hollow cylindrical shaft of any convenient diameter, typically from about 8 millimeters to 22 millimeters in diameter. Disposed on the base member is a polymeric outer layer, which layer can have a thickness that varies, but is preferably from about 3 about to about 6 millimeters thick. The outer layer can be thicker than the foregoing range or harder in durometer if desired to adjust for quality and thickness characteristics of the polymeric release agent 33 at the fusing nip 30. Typically the donor roller 50 is from about 12 to 18 inches in length. The donor roller 50 can be positively driven, but is conveniently driven by frictional contact with fuser roller 20.

The release agent donor roller 50 is typically in the configuration of an economical, highly reliable, long life cylindrical roller which is preferably conformable with a fuser roller 20 and provides substantially uniform delivery of an effective amount of polymeric release agent 33 as previously described. The polymeric release agents employed with the fusing system can be any of those known to the art, such as those referenced in the U.S. Patents previously incorporated herein by reference. Preferably, the polymeric release agent 33 is a poly(Sloane) oil, most preferably a poly(dialkylsiloxane), and most preferably a poly(dimethylsiloxane) oil. Such poly(organosiloxane) oils can generally have a viscosity of from about 10 to about 200,000 centistokes (cts), and preferably, have a viscosity of from about 40 to about 15,000 cts as measured with a Brookfield viscometer at 25.degree. C. The poly(organosiloxane) oil in preferred embodiments also has functional groups in either a terminal position on the siloxane polymer chain, or pendant to such siloxane chain, or both, such as those polymeric release agents disclosed in U.S. Pat. Nos. 4,029,827; 4,101,686; 4,185,140; and 5,157,445 previously incorporated by reference, which groups can interact with the outer surface of the fuser roller 20 such that a thin film of the polymeric release agent is formed on the surface of such fuser roller. In preferred embodiments, the poly(organosiloxane) oil has functional groups, including carboxy, hydroxy, epoxy, isocyanate, thioether, hydride, amino, or mercapto groups, and more preferably hydride, amino or mercapto groups, to provide an interfacial barrier layer between the fusing surface and toner 40 on receiver 42. Blends of such poly(organosiloxane) oils may also be used.

The precision release management system according to this invention is generally designated in FIG. 2 by the numeral 100. Such system 100 includes the donor roller 50, the metering roller 48, the wick 36, the metering blade 49, and the reservoir 34 as described generally above with reference to FIG. 1. In order to provide the precision release agent management of the system 100, these enumerated elements have to be maintained in a particular relationship over a substantial operating range to yield optimum operating characteristics.

In order to create a streak free release agent film, the metering roller 48 needs to be contacted by the wick 36 in the manner as shown in FIG. 2. In addition, the wick 36 also needs to be urged against the metering roller 48 with a predetermined force to guarantee a streak free release agent film on the fuser roller 20. According to one aspect of this invention, the wick force is generated by a wick-supporting bracket 36*a* that is free to rotate around a pivot pin 56 mounted in the system 100 (in the manner discussed below with reference to FIG. 3). At least one, but preferably a pair of loading (compression) springs 58 is located at both cross-track ends of the bracket 36*a* (only one end shown in FIG. 2). The loading springs 58 are supported on posts 58*a* and generate a wick loading force by urging respective U-shaped portions of the bracket 36*a*, in a direction toward the metering roller 48 to urge the wick into engagement with the metering roller at a known predetermined force, substantially uniform along the length of the metering roller. This has the advantage that the wick load on the metering roller 48 is relatively constant over a range of wick thicknesses, caused for example by tolerances in the wick material and the compression of the wick over its life.

Compared to a system with a fixed (i.e., non-pivoting) wick bracket, the precision release agent management system 100 of this invention, with the spring loaded wick bracket 36*a*, induces a much lower drag torque on the metering roller 48, and thus ultimately on the fuser roller 20. Maintaining the system drag torque as low as possible is critical for the life of the fuser roller that gets contacted by the precision release agent management system 100. It also enables the metering roller 48 and the donor roller 50 to rotate at substantially the same speed as the fuser roller 20. By enabling a low system drag less than 5% speed difference can be achieved. That is, there is substantially no slippage between the rollers, which in turn guarantees consistent properties for the precision release agent management system 100, and thus application of a consistent and uniform release agent film on the fuser roller 20.

Figure 3:
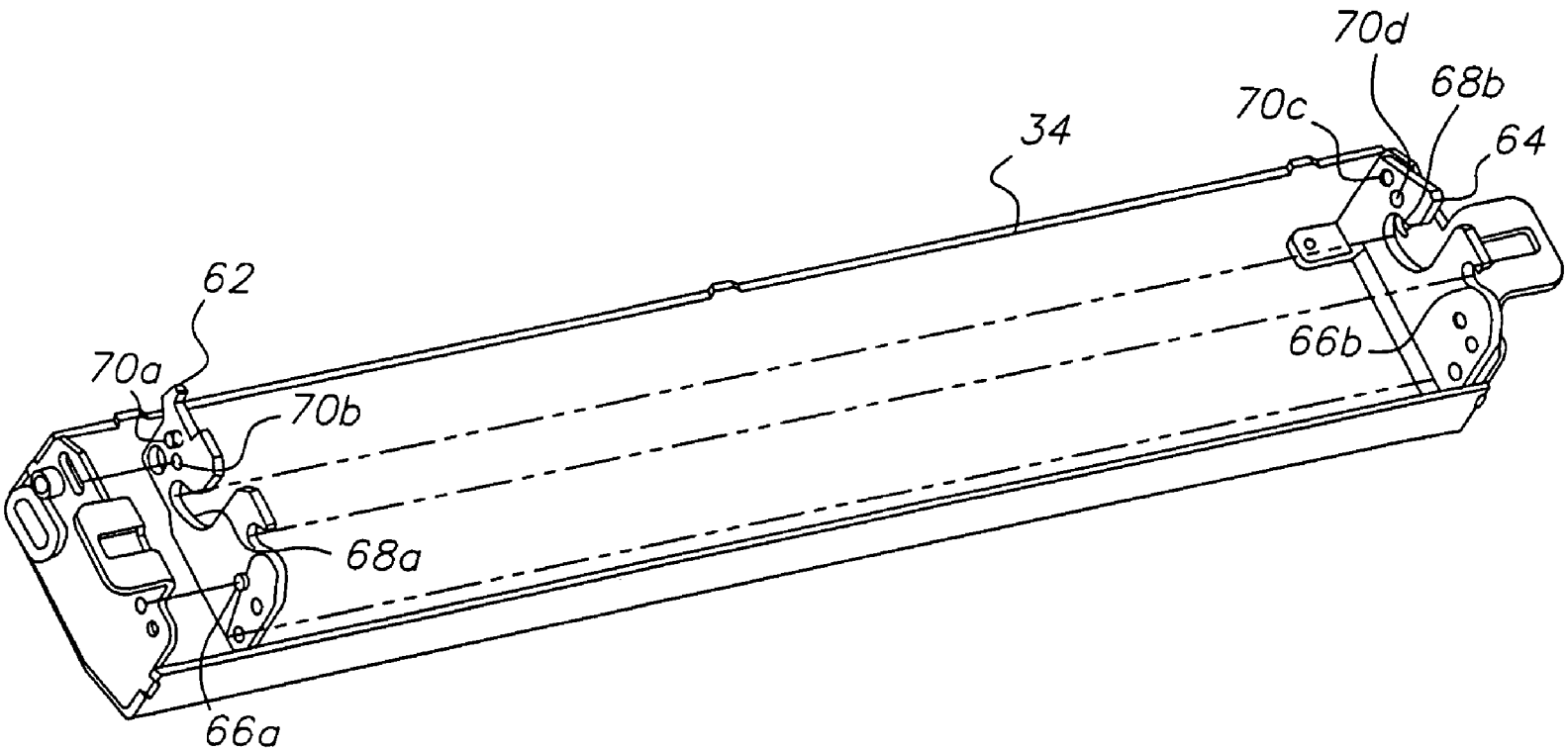
FIG. 3 is a view, in perspective, of a precision locating frame for elements of the precision release agent management system of FIG. 2.
Figure 4:
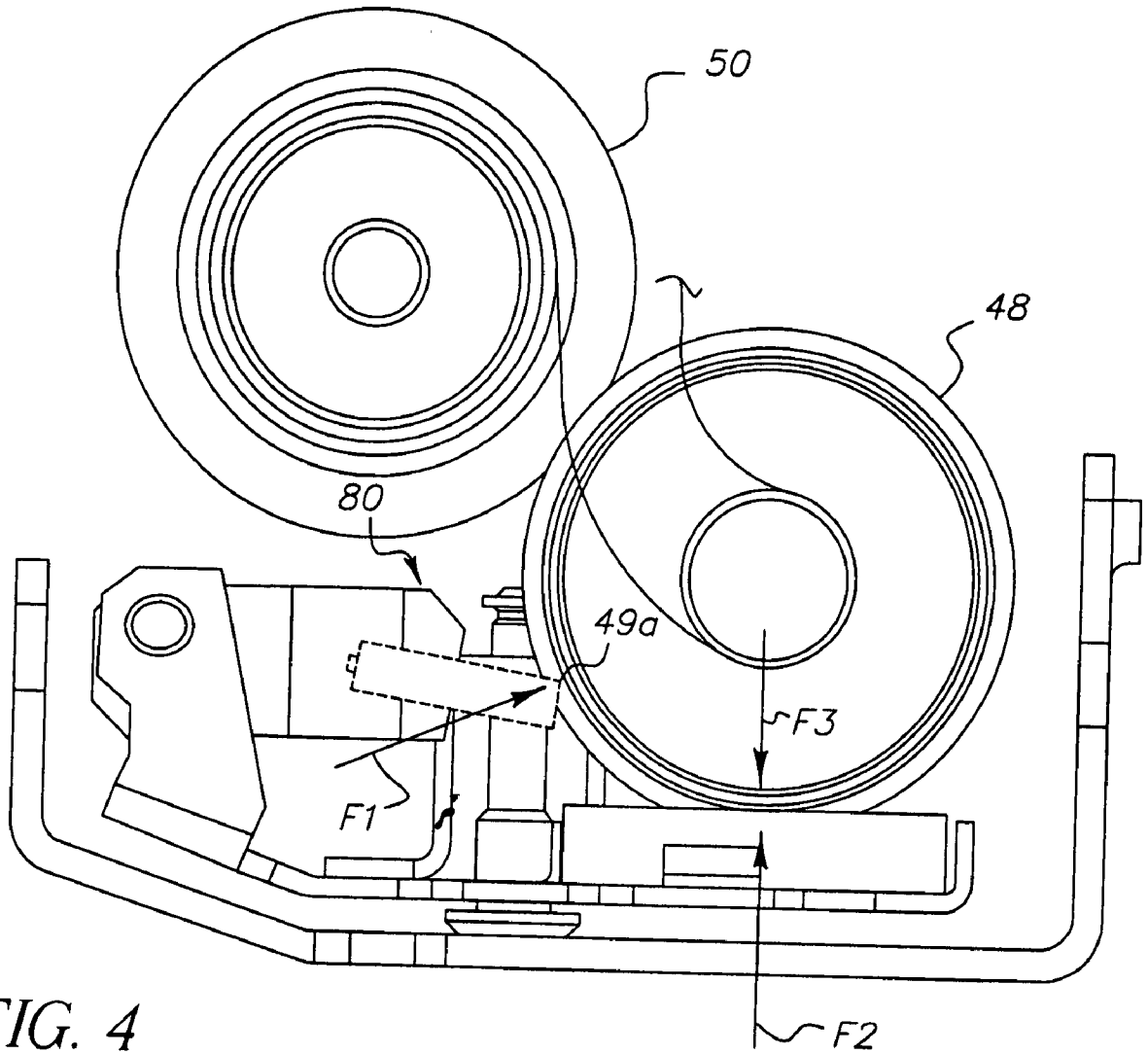
FIG. 4 is a front view, similar to FIG. 2, showing a take-up slot, and associated forces, to provide the metering roller of the precision release agent management systems of FIG. 2 with a self-locking function.

A further aspect of this invention is that the precision release agent management system 100 provides accurate alignment (parallelism) of the three components of the system; i.e., the metering roller 48, the donor roller 50, and the metering blade 49 (and the metering blade holder 80 described herein below with reference to FIG. 4). Such alignment is necessary for the uniformity and stability of the release agent transfer rate in the system 100 and applied release agent film. Accordingly, guide plates 62, 64 are accurately located in, and fixed to, the housing of the reservoir 34 (see FIG. 3). The guide plates 62, 64 have various precise locating features that take up and position the three mentioned components in precise alignment to each other. The precise locating features include a first cooperating pair of slots 66*a*, 66*b*, a second cooperating pair of slots 68*a*, 68*b*, and a plurality of precisely spaced through bores 70*a*–70*d*, all positioned at predetermined locations relative to one another in the guide plates 62, 64. The first pair of slots 66*a*, 66*b* is adapted to receive the ends of the donor roller shaft 50*a*. The second pair of slots 68*a*, 68*b* is adapted to receive the ends of the metering roller shaft 48*a*. The through bores 70*a*–70*d* are adapted to receive pins (not shown) for the metering blade holder 80. As such, when the shafts 50*a* and 48*a* are respectively received in the slots 68*a*, 68*b* and 66*a*, 66*b*, and the pins of the metering blade holder 80 are received in the bores 70*a*–70*d*, the elements of the precision release agent management system 100 are precisely located relative to one another and are maintained in such precise arrangement. Any adjustment beyond that provided by these features is therefore not necessary.

The alignment is especially important between the metering blade and the metering roller so that the load between the metering blade edge and the metering roller is consistent, which is vital for a uniform release agent film thickness.

In order to keep the properties of the precision release agent management system 100 consistent, it is important that during operation the metering roller 48 stays locked in place. On the other hand, the metering roller 48 needs to be easily removable for serviceability of the precision elements of the release agent management system 100. The arrangement of the features, described with reference to FIG. 3, provides for the force F1 (load of the metering blade 49 on the metering roller 48 at edge 49*a*), force F2 (load of the wick 36 on the metering roller 48), the weight F3 of the metering roller 48, and the geometry of the metering roller take up slot 68*a*, 68*b* assures that the metering roller 48 is always locked in its place during operation without requiring any additional lock down mechanisms. This arrangement also assures that the removal of the metering roller 48 for system serviceability is easy and quick. For a low drag precision release agent management system 100 given a 12-inch metering roller 20 to achieve a 1 to 2 lb drag the wick load F2 needs to be 6 to 9 lbs. Likewise to achieve a low metering blade drag in the order of 3.5 to 5.0 oz the blade 49 load F1 needs to be 4.5 to 6.5 lb.

Figure 5:
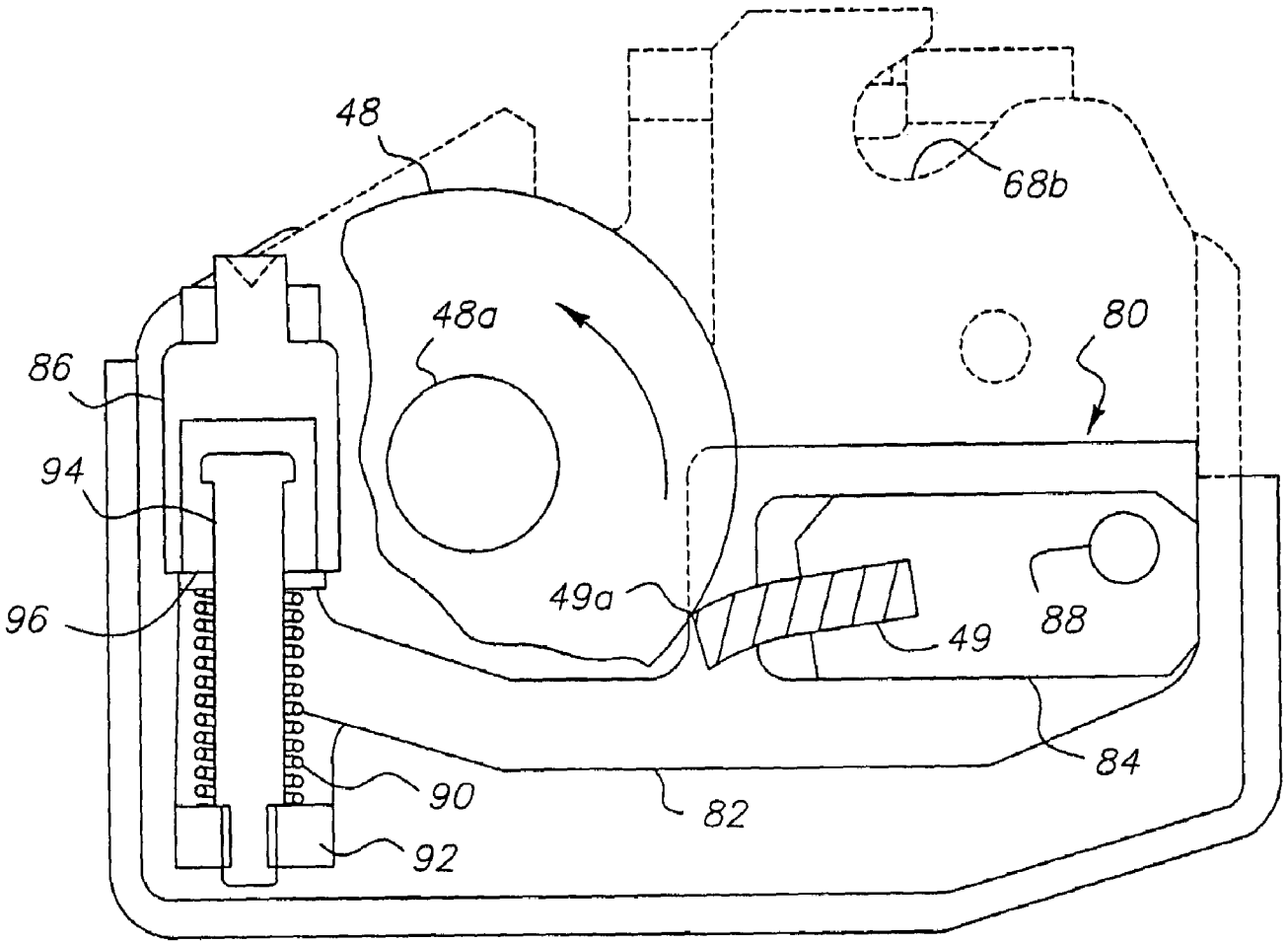
FIG. 5 is a rear view, similar to FIG. 2, showing a spring loaded wick holder for the precision release agent management system of FIG. 2.

In still another aspect of this invention, the metering blade 49 is contained in the metering blade holder 80 in the described manner. The metering blade holder 80 includes a blade holder arm 82, a blade retainer element 84, and a loading cup 86. These blade holder elements are rigidly connected to form a loading arm assembly. The pivot point 88 of this assembly is the pivot point of the blade retainer element 84. By rotating the loading arm assembly clockwise around its pivot point 88, the metering blade 49 is loaded against the metering roller 48. The actual loading force is provided by a compression spring 90 that rests on a base plate 92 coupled to the housing of the reservoir 34. The compression spring 90 is constrained for movement about a spring retaining stud 94 that keeps the spring 90 in place and engagement with a washer 96 that slides on the spring retaining stud 94. The action of the spring 90 and the washer 96 transmits a loading force to loading cup 86 and thus the loading arm assembly. That is, in the assembled position, as shown in FIG. 5, the loading cup 86 of the loading arm assembly exerts a force on the washer 96 to compress the compression spring 90, which creates a reaction force that urges the loading arm assembly in a direction that loads the metering blade 49 against the metering roller 48.

The load of the metering blade 49 on the metering roller 48 is thus the product of the compression spring 90 and the rubber material of the metering blade 49. The force that is critical for the appropriate desired rate of the release agent on the metering roller 48 is the force on the edge of the metering blade 49 that contacts the metering roller surface. The balance of the compression spring 90 and the rubber material of the metering blade 49 determines this edge force (blade load), where the spring constant of the compression spring 90 is much lower than the spring constant of the rubber material of the metering blade 49. The advantage of this blade loading system is that the blade load can be held sufficiently constant despite any tolerances in the parts involved, because slight changes in the deflection of the compression spring 90 causes only little changes in the force it puts out. On the other hand, if the metering blade were loaded up by displacement of the loading arm assembly, slight changes of this displacement, caused by tolerances, would cause significant changes in the metering blade load and would thus change the rate of the release agent significantly as well.

The invention has been described in detail with particular reference to certain preferred embodiment thereof, but it will be understood that variations and modifications can be effected within the spirit and scope of the invention.

What is claimed is:

1. A precision release agent management system for an electrostatographic reproduction apparatus fuser device, said precision release agent management system comprising:

a reservoir adapted to contain a release agent;

a wick for absorbing release agent from said reservoir;

a metering member for receiving release agent from said wick;

a support for said wick resiliently urging said wick into operative contact with said metering member said wick support including a wick-supporting bracket supported for free rotation about a pivot pin at least one loading spring located to apply a force to said bracket to urge said bracket into uniform engagement with said metering member, said at least one loading spring being a compression spring supported on a post, urging a U-shaped portion of said bracket in a direction toward said metering member so as to urge said wick into engagement with said metering member at a predetermined force, substantially uniform along the length of the metering member, wherein said wick load on said metering member is substantially constant over a range of wick thicknesses, caused by tolerances in said wick material and the compression of said wick over its life;

a blade member associated with said metering member to establish a desired thickness of release agent on said metering member;

a donor member adapted to receive release agent from said metering member, and operatively contacting said fuser device to apply said release agent thereto; and a plurality of features associated with said reservoir for precise alignment of said donor member, metering member, and said metering blade.

2. The precision release agent management system according to claim 1, wherein said at least one loading spring is a pair of compression springs respectively acting on the cross-track ends of said bracket.

3. The precision release agent management system according to claim 1, wherein said plurality of features, for the uniformity and stability of the release agent transfer rate in said system, includes guide plates accurately located in, and fixed to, the housing of the reservoir, said guide plates having various precise locating features.

4. The precision release agent management system according to claim 3, wherein said locating features include a first cooperating pair of slots, a second cooperating pair of slots, and a plurality of precisely spaced through bores, all positioned at predetermined locations relative to one another in said guide plates.

5. The precision release agent management system according to claim 4, wherein said first pair of slots is adapted to receive the ends of said donor member, said second pair of slots is adapted to receive the ends of said metering member, and said through bores are adapted to receive pins for said blade member, wherein when shafts for said metering member and said donor member are respectively received in first and second pairs of slots, and said blade member is received in said through bores, the elements of said precision release agent management system are precisely located relative to one another and are maintained in such precise aligned arrangement.

6. The precision release agent management system according to claim 5, wherein the load of said metering blade member on said metering member, the load of said wick on said metering member, the weight of said metering member, and the geometry of said take up slots for said metering member assures that said metering member is always locked in place during operation of said precision release agent management system, and also assures that removal of the metering member for system serviceability is easy and quick.

7. The precision release agent management system according to claim 1, wherein said blade member is supported by a blade member holder, and said metering blade holder urges said blade member, under constant force, into contact with said metering member.

8. The precision release agent management system according to claim 7, wherein said blade member holder includes a blade holder arm, a blade retainer element, and a loading cup, such elements being rigidly connected to form a loading arm assembly rotatable about a pivot point for said blade retainer element, wherein rotation of said loading arm assembly about its pivot point loads said blade member against said metering member.

9. The precision release agent management system according to claim 8, wherein said blade member holder further includes a compression spring resting on a base plate coupled to the housing of said reservoir, a spring retaining stud, and a washer slidable on said spring retaining stud, said compression spring being constrained for movement about said spring retaining stud that keeps said compression spring in place and engagement with said washer for transmitting a loading force to a loading cup and thus to said loading arm assembly, wherein said loading cup of said loading arm assembly exerts a force on said washer to compress said compression spring to create a reaction force that urges said loading arm assembly in a direction that loads said blade member against said metering member, with the load of said blade member on said metering member thus being the product of said compression spring and the material of said blade member, such force on the edge of the blade member that contacts the metering member surface being necessary for the appropriate desired rate of release agent applied on said metering member.

10. The precision release agent management system according to claim 9, wherein said blade load is substantially constant despite any tolerances in the parts involved, because slight changes in the deflection of said compression spring causes only little changes in the force it puts out.

* * * * *